United States Patent [19]

Pollock

[11] 4,013,045

[45] Mar. 22, 1977

[54] TWIN FURNACE INDUSTRIAL BOILER

[75] Inventor: William Hunter Pollock, East Granby, Conn.

[73] Assignee: The Air Preheater Company, Inc., Wellsville, N.Y.

[22] Filed: Apr. 28, 1976

[21] Appl. No.: 680,839

[52] U.S. Cl. ..... 122/240 R; 122/240 A; 122/330

[51] Int. Cl.[2] ..... F22B 31/04

[58] Field of Search .... 122/235 MF, 235 V, 240 R, 122/240 A, 240 B, 327, 328, 329, 330, 333, 332

[56] References Cited

UNITED STATES PATENTS

| | | | |
|---|---|---|---|
| 2,374,818 | 5/1945 | Jacobs | 122/330 |
| 2,800,116 | 7/1957 | Raynor et al. | 122/240 |
| 3,289,642 | 12/1966 | Schoppe | 122/240 |
| 3,736,907 | 6/1973 | Agrest | 122/240 |
| 3,841,275 | 10/1974 | Bisbee et al. | 122/240 |

*Primary Examiner*—Kenneth W. Sprague
*Attorney, Agent, or Firm*—Wayne H. Lang

[57] ABSTRACT

A coal fired steam generating boiler of high thermal capacity that is shop assembled and transported as a complete unit for installation at a given site. The boiler includes a pulverized coal burner at opposite ends thereof and an intermediate tube bank section that is adapted to increase the capacity of the shop assembled unit. Alternatively, the arrangement may be used with oil or gas fired burners at opposite ends thereof to achieve a maximum capacity in a minimum of space.

6 Claims, 4 Drawing Figures

TWIN FURNACE INDUSTRIAL BOILER

BACKGROUND OF THE INVENTION

The present invention relates to steam boilers of a type known as "package boilers" that are completely manufactured and assembled in a shop and thereafter transported as a unit to be installed at a given plant site. A burner unit is provided at each of opposite ends thereof to significantly increase the capacity of a coal fired unit.

An important disadvantage of shop built and assembled boilers is that such apparatus is limited in size by the carrying capacity of the railway carrier by which it is delivered to its place of use. Such limitations are imposed upon the apparatus chiefly by railroad clearances encountered along the route of transit. Inasmuch as package boilers are thus limited in size, their capacity is similarly limited, and by necessity they have been effectively limited to the use of highly efficient fuels such as gas or oil.

SUMMARY OF THE INVENTION

According to the present invention there is provided a shop constructed and assembled package boiler having a substantial increase in capacity over what is realized in conventional designs. The increased capacity makes it possible to include a hopper bottom with a longitudinal gap through which residual ash may be discharged, a necessary adjunct to the burning of pulverized coal. This arrangement will increase the length of an effective package boiler, but it will simultaneously increase the capacity of a boiler that may be shop assembled and shipped to a customer's plant site by rail.

The dual-ended furnace of the present invention may otherwise be modified to include oil or gas fired burners at opposite ends thereof that require, for a given output, a smaller flame than is required for a coal fired unit. This would reduce the possibility of flame impingement on the furnace side walls, and it would allow greater steam capacities to be achieved without the harmful effects of a large burner flame.

With the present day demands for boilers that utilize various fuels, especially readily available pulverized coal, it becomes a principle object of this invention to provide a shop assembled package boiler for the efficient burning of pulverized coal.

It is a further object of the invention to provide a boiler with fuel burners at opposite ends thereof that will require a minimum amount of fuel thereby reducing the size of flame required for a given output, while simultaneously reducing the possibility of flame impingement on the sidewalls of the boiler.

A better understanding of the invention may be had by reference to the detailed description of a preferred embodiment thereof taken in conjunction with the accompanying drawings in which:

FIG. 1 is an end elevation of a boiler furnace according to the present invention, FIG. 2 is a top plan of the device of FIG. 1, FIG. 3 is an end view as seen from line 3—3 of FIG. 2, and FIG. 4 is a partial side view as seen.

DESCRIPTION OF THE PREFERRED EMBODIMENT

Figure 1:
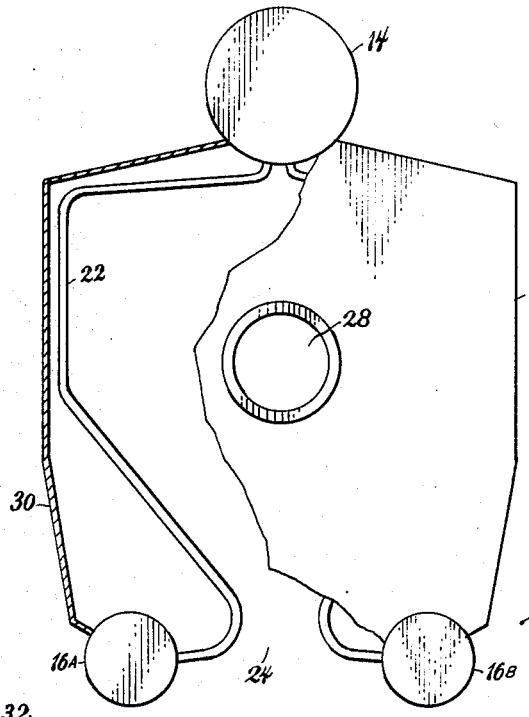

Referring more particularly to FIG. 1 there is shown a schematic representation of a shop assembled package boiler 12 commonly referred to as an A-type boiler. The boiler comprises a single horizontal drum 14 that extends along the apex thereof, while a pair of lower horizontally disposed drums 16A and 16B are under drum 14 and at opposite sides thereof to form a symmetrical base for the boiler. The lower drums are relatively small in diameter and are totally enclosed at the ends thereof to comprise a cylindrical shell, while the upper drum 14 is enclosed at its ends and of similar length but of substantially greater diameter.

A series of tubular members 22 are reversely bent to form tube walls that connect each lower drum 16A–B with the upper drum 14 for fluid flow whereby fluid may circulate freely between the lower and the upper drums. In the space surrounded by the tubes 22 is a central furnace space having tubular walls and a hopper-type bottom with a transverse gap 24. The tubes forming the hopper-type bottom are inclined to form a slope greater than the angle of rest for ash or other particulate matter thereon, whereby said ash may be discharged continuously through the transverse gap 24 to an enclosed pit.

The boiler is provided at opposite ends thereof with end walls 26A and 26B that enclose the cavity formed by the bent boiler tubes, and each end wall is in turn formed to include an opening 28 for the receiption of an independent fuel burner 32 that permits the burning of fuel such as pulverized coal.

Figure 2:
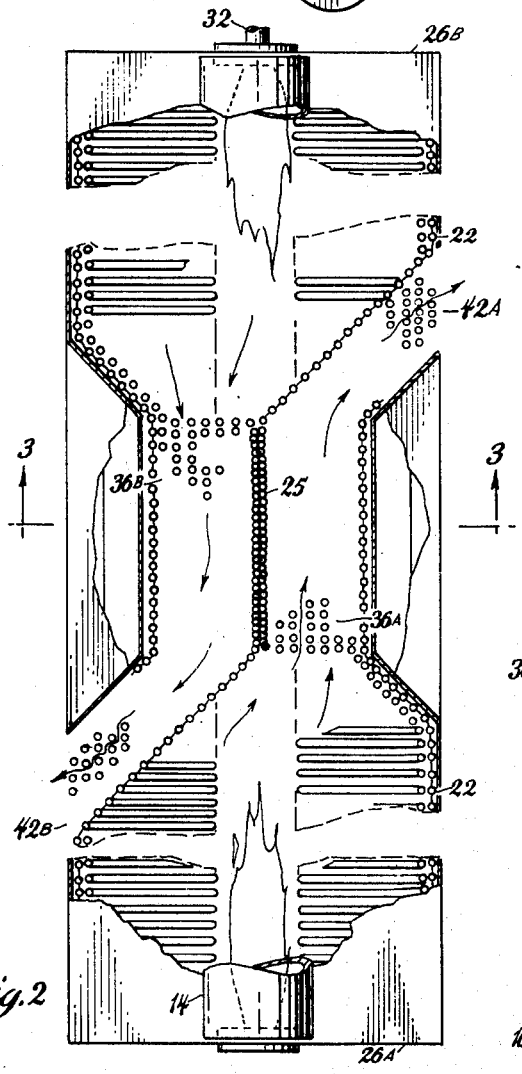
Figure 3:
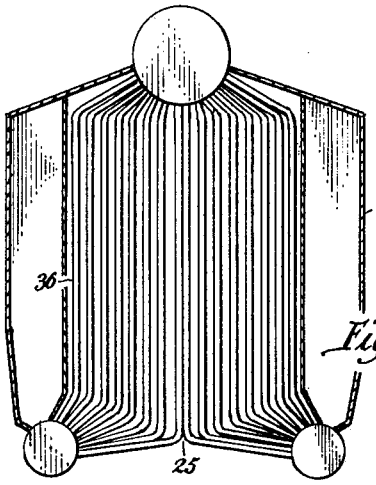
Figure 4:
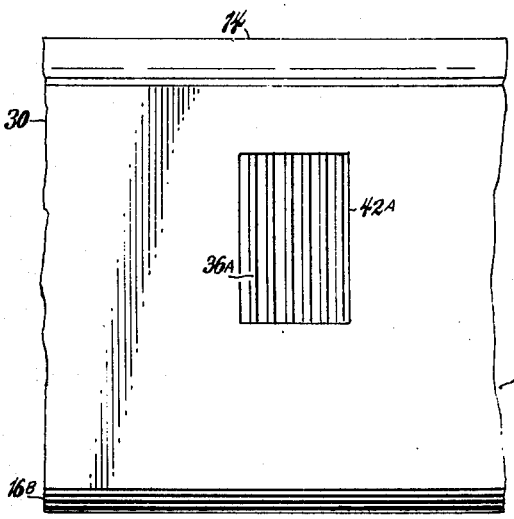

A bank of substantially vertical boiler tubes 36 is positioned midway between ends of the boiler to absorb heat from the hot gases exhausting from the burners 32. A tube wall 25 extending longitudinally along the centerline thereof divides the tube bank 36 into longitudinally equal sections 36A and 36B while opposite ends of said tube wall extend laterally to the tubular walls 22 on opposite sides of the boiler in the manner shown by FIG. 2 to form a modified Z-shaped wall extending across the boiler and effectively dividing the boiler into two equal sections.

Each boiler thus includes independent burner sections at opposite ends thereof that discharge exhaust gases therefrom oppositely into the interior of said boiler and over a mass of heat absorbent boiler tubes 36A and 36B. Although the tube walls 22 and the tubes 36 similarly interconnect the boiler drum 14–16, the tube walls 22 together form an intermediate tube wall 25 that serves to separate the unit into a pair of independent boilers having burners at opposite ends.

The composite side walls comprised of boiler tubes 22 including opposite ends 26A and 26B are covered with refractory material and enclosed in steel plates 30 or the like that form a continuous outer covering. The covering is formed with suitable openings 28 in the ends thereof for the fuel burners, and openings 42A and 42B in the side walls thereof for the exhaust of combustion gases from within the boiler.

Thus, a single unit is provided wherein gases from a burner at end 26A are directed into the furnace cavity, over the tube walls 22 and boiler tubes 36A to outlet 42A, while gases from burner 32 at the spaced end 26B are directed oppositely over tube walls 22 and tube section 36B to outlet 42B.

There is thus provided a package type boiler having a burner at opposite ends thereof adapted to use readily available pulverized coal. If oil or gas are available, the burners may be adapted to burn them while producing a small flame that reduces the possibility of flame impingement on the side walls of the furnace.

The invention described herein and illustrated in the accompanying drawings is known to admit to various modifications. Accordingly, various changes may be made without resorting to invention. Thus, such modifications are considered to lie within the spirit and scope of the appended claims.

I claim:

1. A shop assembled boiler comprising an upper drum that extends horizontally to form a ridge along the apex of an A-type boiler, a pair of lower drums positioned under the upper drum and spaced apart to comprise a base for said boiler, a plurality of tubular members connecting the lower drums with the upper drum to provide side walls enclosing a furnace cavity having a hopper bottom on opposite sides of an elongate throat, an end wall at each end of the boiler adapted to enclose the furnace cavity, a central tube bank intermediate opposite end walls adapted to absorb heat generated in the furnace cavity, and fuel burning apparatus in each end wall arranged to exhaust hot gases oppositely therefrom into the interior of said furnace cavity and over the bank of boiler tubes therebetween.

2. A boiler comprising an upper drum and a pair of lower drums are defined in claim 1 including a tube wall connecting lower and upper drums and dividing the bank of boiler tubes, said tube wall being washed on opposite sides thereof by combustion gases generated by the fuel burners at opposite ends of the boiler.

3. A boiler comprising an upper drum and a pair of lower drums as defined in claim 2 including a housing adapted to enclose said boiler, and outlet ports in said housing on opposite sides of the tube wall arranged to exhaust gases after said gases have contacted the bank of boiler tubes.

4. A boiler comprising an upper drum and a pair of lower drums as defined in claim 1 including a tube wall extending between the lower and upper drums arranged to divide the furnace casing into dependent sections that contain combustion gases from fuel burners at opposite ends of the boiler.

5. A boiler comprising an upper drum and a pair of lower drums as defined in claim 4 wherein the tube wall that divides the bank of boiler tubes lies between fuel burning apparatus at opposite ends of the boiler to provide substantially equal boiler sections.

6. A boiler comprising an upper drum and a pair of lower drums as defined in claim 5 wherein the tube wall that divides the bank of boiler tubes lies along a line parallel to the longitudinal axis of the boiler.

* * * * *